US006624591B2

(12) United States Patent
Mori et al.

(10) Patent No.: US 6,624,591 B2
(45) Date of Patent: Sep. 23, 2003

(54) PLASMA DISPLAY PANEL

(75) Inventors: Hiroshi Mori, Kanagawa (JP); Satoshi Nakada, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/095,051

(22) Filed: Mar. 12, 2002

(65) Prior Publication Data

US 2002/0130619 A1 Sep. 19, 2002

(30) Foreign Application Priority Data

Mar. 12, 2001 (JP) ..... 2001-068856

(51) Int. Cl.[7] ..... G09G 3/10; H01J 17/49

(52) U.S. Cl. ..... 315/169.3; 313/582

(58) Field of Search ..... 315/169.1, 169.3, 315/169.4; 313/483, 185, 582, 583, 584; 345/55, 60, 66

(56) References Cited

U.S. PATENT DOCUMENTS 5,989,089 A * 11/1999 Ichiyoshi et al. ..... 445/24
6,242,860 B1 * 6/2001 Sasao et al. ..... 313/586
6,495,957 B2 * 12/2002 Kurogi et al. ..... 313/584
6,518,702 B1 * 2/2003 Mori ..... 313/582

* cited by examiner

*Primary Examiner*—Don Wong
*Assistant Examiner*—Minh D A
(74) *Attorney, Agent, or Firm*—Rider, Fishman & Grauer PLLC; Ronald P. Kananen

(57) ABSTRACT

At least one pair of stripe shaped second discharge maintaining electrodes are formed between a second dielectric layer and a first dielectric layer so as to correspond to a first discharge maintaining electrodes, a second discharge maintaining electrodes have an electric resistance lower than that of the first discharge maintaining electrodes, at least one pair of bus electrodes are overlapped to the second discharge maintaining electrodes along a direction of length of two edges adjacent to each other of the pair of the first discharge maintaining electrodes.

23 Claims, 4 Drawing Sheets

PLASMA DISPLAY PANEL

BACKGROUND OF THE INVENTION

The present invention relates to a plasma display panel and, more particularly, to an alternating-current, plasma display flat panel having plasma discharge maintaining electrodes of a two-layer structure.

Known as an alternating-current, plasma display flat-panel having discharge maintaining electrodes of a two-layer structure is a display panel reported in the proceedings of IDW '00, at page 611. As shown in FIG. 1A, for example, the display panel described in the literature has a dielectric layer 130 and a protective layer 134 formed into a laminate on a discharge space 120 side surface of a transparent glass 104 having a display surface side surface 104*a*. A plurality of pairs of first discharge maintaining electrodes 140 are formed in a stripe manner between the glass substrate 104 and the dielectric layer 130. The first discharge maintaining electrodes 140 are formed by a transparent ITO (Indium Tin Oxide) film or the like.

Second discharge maintaining electrodes 144 formed by a metallic layer of low resistance are buried inside the dielectric layer 130 between the first discharge maintaining electrodes 140 and the protective layer 134 in such a manner as to correspond to the first discharge maintaining electrodes 140. The second discharge maintaining electrodes 144 are connected to their corresponding first discharge maintaining electrodes 140 at an electrode lead portion, so that the second discharge maintaining electrodes 144 are maintained at the same potential as the first discharge maintaining electrodes 140.

The above-mentioned literature reports that such an alternating-current, plasma display, flat panel having discharge maintaining electrodes of a two-layer structure can improve luminous brightness and luminous efficiency as compared with a conventional display panel with no second discharge maintaining electrodes 144.

In addition, as shown in FIG. 1B, a display panel is known which has a structure with discharge maintaining electrodes 140 but without second discharge maintaining electrodes, and it has bus electrodes 142 formed along edges of a pair of discharge maintaining electrodes 140 at sides distant from each other. The bus electrodes 142 are formed by a metallic film of lower electric resistance than that of the discharge maintaining electrodes 140 formed by a transparent conductive film. This is because the high-resistance discharge maintaining electrodes 140 alone have too high a resistance value along a direction of length of the discharge maintaining electrodes, which is disadvantageous to the manufacturing of large-screen displays.

Incidentally, the conventional plasma display panel has the bus electrodes 142 formed along the edges of the pair of discharge maintaining electrodes 140 at the sides distant from each other, rather than the sides adjacent to each other, because such an arrangement has been considered to increase brightness. Since the strongest discharge occurs on the sides adjacent to each other of the pair of discharge maintaining electrodes 140, it has been considered better to dispose the bus electrodes 142 formed by a metallic film having a light shading property away from the portion where the strong discharge occurs.

From a viewpoint of improving the luminous brightness and the luminous efficiency of a flat-panel display, there is a desire to employ discharge maintaining electrodes of a two-layer structure as shown in FIG. 1A. Further, from a viewpoint of reducing the resistance of discharge maintaining electrodes, there is a desire to provide bus electrodes on the discharge maintaining electrodes, as shown in FIG. 1B. However, if the discharge maintaining electrodes of the two-layer structure shown in FIG. 1A are further provided with discharge bus electrodes 142, as shown in FIG. 1B, then there occurs the following problem.

The second discharge maintaining electrodes 144 and the bus electrodes 142, which are each formed by metallic film for a lower resistance value, block display light emitted from the discharge space 120 to the display surface side surface 104*a*, resulting in a decrease in brightness.

SUMMARY OF THE INVENTION

Accordingly, it is an object of the present invention to provide a plasma display panel that can efficiently generate strong vacuum ultraviolet rays by plasma, and that enables relatively low-voltage driving even at a high luminous brightness and luminous efficiency.

In order to achieve the above object, according to an aspect of the present invention, there is provided a plasma display panel including:

- a transparent first substrate having a display surface side surface;
- a second substrate disposed such that a sealed plasma discharge space is formed between the first substrate and the second substrate;
- a first dielectric layer formed on a discharge space side surface of the first substrate opposite from the display surface side surface;
- at least one pair of transparent first discharge maintaining electrodes formed in a stripe manner between the first substrate and the first dielectric layer;
- a second dielectric layer formed on a discharge space side surface of the first dielectric layer;
- at least one pair of second discharge maintaining electrodes formed in a stripe manner between the second dielectric layer and the first dielectric layer so as to correspond to the first discharge maintaining electrodes, the second discharge maintaining electrodes having an electric resistance lower than the electric resistance of the first discharge maintaining electrodes; and
- at least one pair of bus electrodes disposed so as to be overlapped by the second discharge maintaining electrodes along a direction of length of two edges adjacent to each other of the pair of first discharge maintaining electrodes as viewed from the display surface side surface of the first substrate, the bus electrodes having an electric resistance lower than the electric resistance of the first discharge maintaining electrodes.

Preferably, the bus electrodes and the second discharge maintaining electrodes completely overlap each other. Alternatively, the bus electrodes and the second discharge maintaining electrodes may overlap each other at least in part.

Preferably, the width of the bus electrodes is smaller than the width of the second discharge maintaining electrodes.

Preferably, the distance between the pair of second discharge maintaining electrodes is smaller than the distance between the pair of bus electrodes.

The distance between the pair of second discharge maintaining electrodes is preferably less than 50 $\mu$m and 5 $\mu$m or more, more preferably less than 30 $\mu$m and 5 $\mu$m or more, and most preferably 20 $\mu$m to 10 $\mu$m.

The thickness of at least one of the first dielectric layer and the second dielectric layer is preferably 20 μm or less and 5 μm or more, more preferably 15 μm or less and 5 μm or more, and most preferably 10 μm to 5 μm. The second dielectric layer, in particular, is preferably thinner than the first dielectric layer.

Preferably, at least one of the first dielectric layer and the second dielectric layer is formed by a thin film including at least one of silicon oxides, silicon nitrides, and metallic oxides (for example, aluminum oxide). The second dielectric layer, in particular, is preferably formed by a thin film including a silicon oxide or a silicon nitride.

Preferably, at least one of the first dielectric layer and the second dielectric layer is formed by a thin film forming process. The second dielectric layer, in particular, is preferably formed by a thin film forming process. The thin film forming process is exemplified by a vacuum deposition process, a sputtering process, a chemical vapor deposition process, an ion plating process and the like, although it is not particularly limited to these examples. Incidentally, the first dielectric layer may be formed by a thick film forming process such as a printing process.

The plasma discharge space is filled with a discharge gas, and the concentration of xenon in the discharge gas is preferably 10% or more by volume and 100% or less by volume, more preferably 20% by volume to 100% by volume, and most preferably 30% by volume to 70% by volume. A neon-xenon gas (mixed gas of neon and xenon) or a helium-xenon gas (mixed gas of helium and xenon), for example, is used as the discharge gas, although the discharge gas is not particularly limited to these examples. The pressure of the discharge gas filled into the plasma discharge space is preferably 50 torr to 600 torr (6.7 kPa to 79.8 kPa), and more preferably 150 torr to 500 torr (20.0 kPa to 66.5 kPa), although it is not particularly limited to these examples.

BRIEF DESCRIPTION OF THE DRAWINGS

These and other objects of the invention will be seen by reference to the description, taken in connection with the accompanying drawing, in which.

DETAILED DESCRIPTION OF THE PREFERRED EMBODIMENT

Figure 1A:
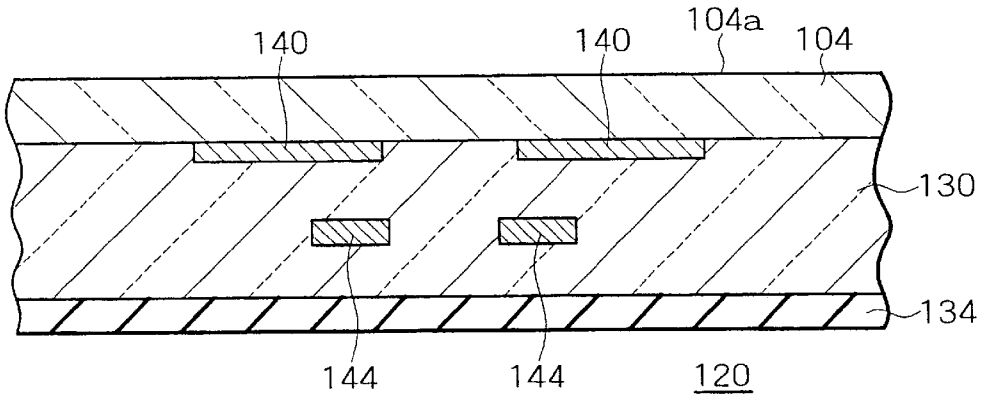
FIGS. 1A and 1B are partial sectional views of a first substrate side of plasma display panel according to conventional examples.
Figure 1B:
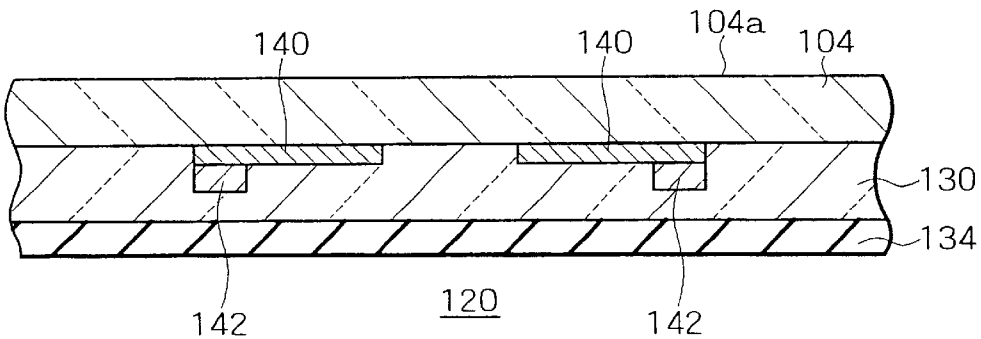

The present invention will hereinafter be described on the basis of an embodiment shown in the drawings.

Structure of Plasma Display Panel

Figure 2:
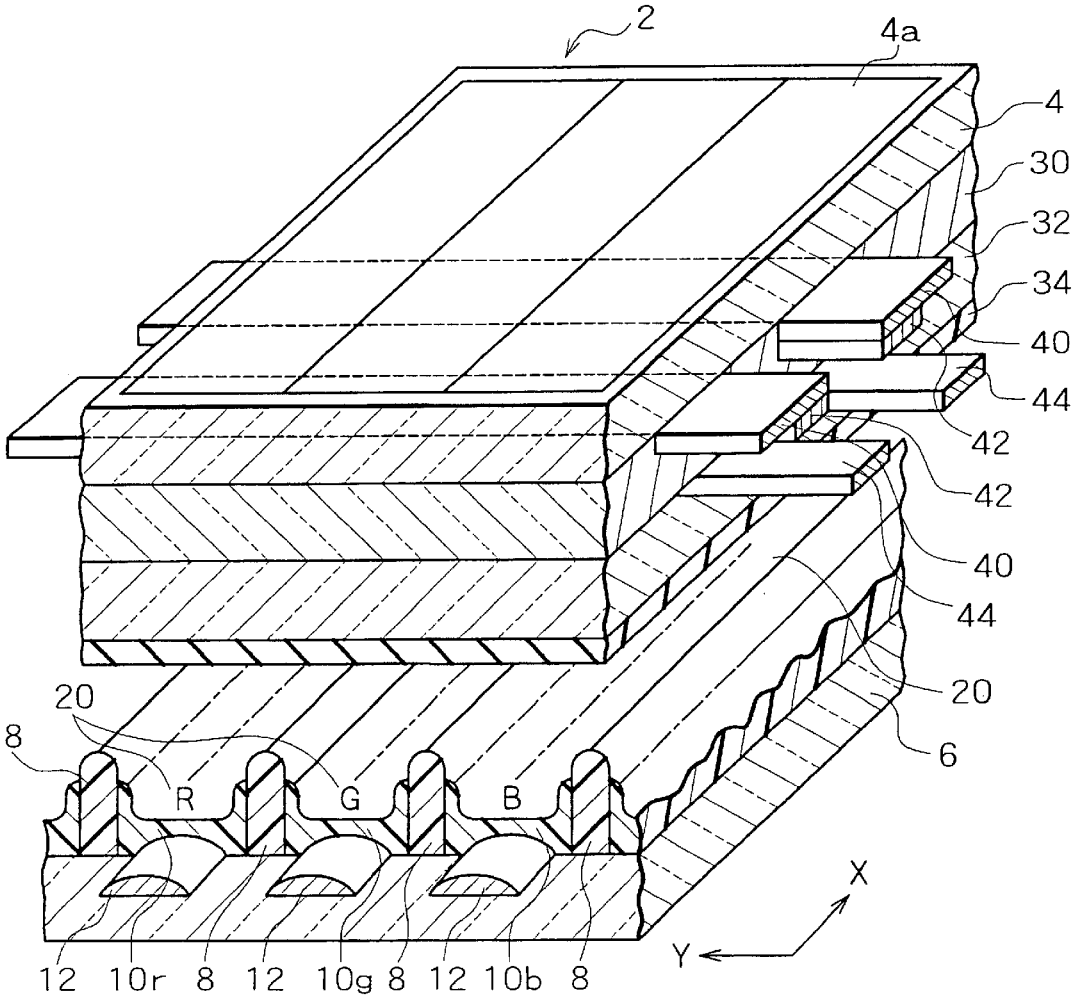
FIG. 2 is a partially exploded perspective view of a plasma display panel according to an embodiment of the present invention.
Figure 3:
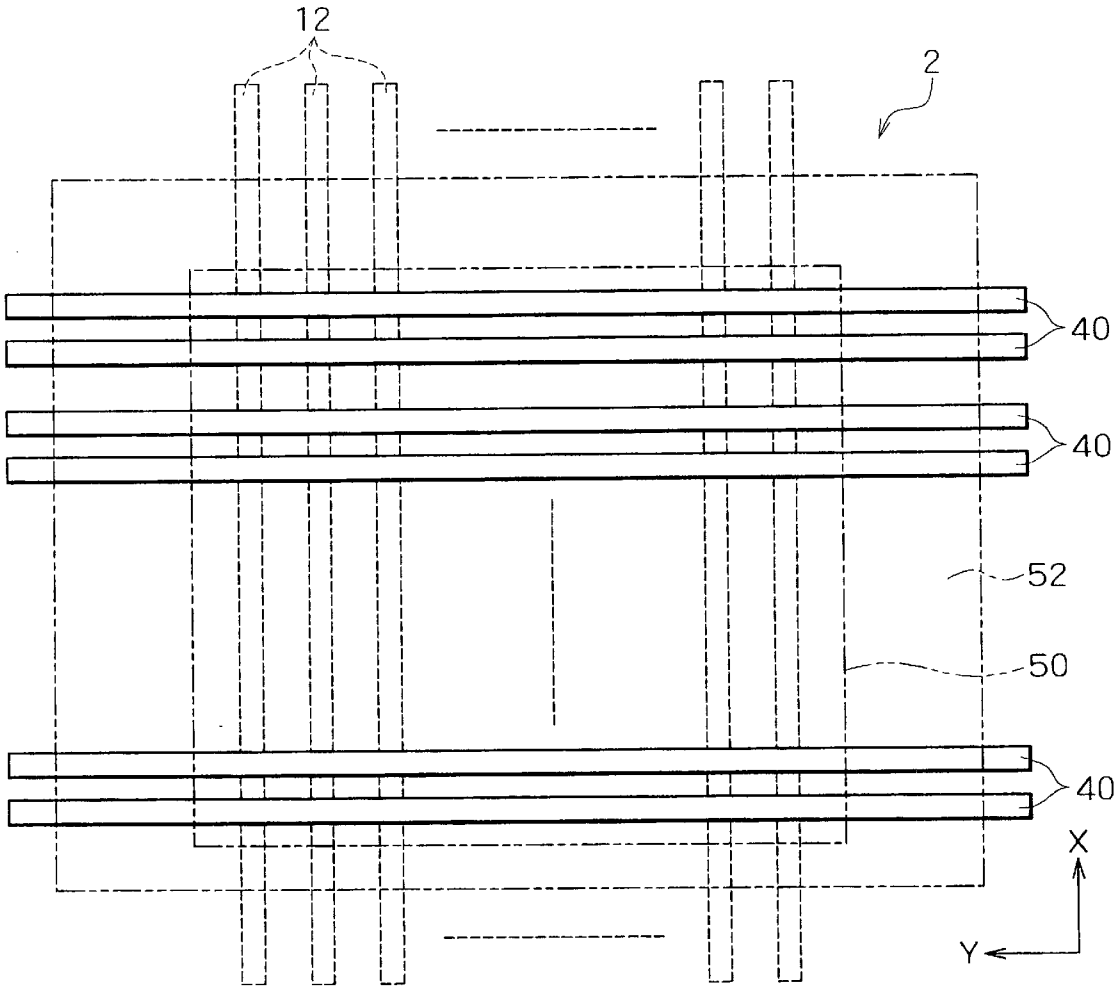
FIG. 3 is a schematic plan view showing a relation between discharge maintaining electrodes and address electrodes in the display panel shown in FIG. 2.

As shown in FIG. 2 and FIG. 3, a plasma display panel according to an embodiment of the present invention is a plasma display flat panel of a so-called alternating-current surface discharge type. The plasma display panel includes a first substrate 4 having a display surface side surface 4*a* and a second substrate 6 disposed opposite to and in parallel with the first substrate 4. A plasma discharge space 20 is formed between the first substrate 4 and the second substrate 6. The first substrate 4 is formed by a transparent glass substrate, whereas the second substrate 6 may not necessarily be transparent. The glass substrate forming the first substrate 4 and the second substrate 6 is exemplified by a soda-lime glass and a high strain point glass, although it is not particularly limited to these examples.

Sets of address electrodes 12 corresponding in number with that of pixels, each of the sets being formed by three address electrodes 12 for RGB, are formed in a stripe manner along an X-direction and in parallel with one another at predetermined intervals along a Y-direction (perpendicular to the X-direction) on a surface (surface on the discharge space 20 side) of the second substrate 6. The address electrodes 12 are formed by stripe-shaped metallic conductive films. The address electrodes 12 can be formed of a silver-aluminum alloy, for example, and by screen printing, for example, although they are not particularly limited to these examples. The address electrode 12 has a width of about 50 to 100 μm, for example.

Barrier ribs 8 formed in a stripe manner along the X-direction are formed on the surface of the second substrate 6 at predetermined intervals in the Y-direction in such a manner as to divide the address electrodes 12 from each other. The barriers rib 8, for example, have a width of about 50 μm or less and a height of about 100 to 150 μm. The barrier ribs 8 have a pitch interval of about 100 to 400 μm, for example. Preferably, the barrier ribs 8 are formed of an electrically insulating material, and they are opaque from a viewpoint of contrast enhancement. Although the specific material for the barrier ribs 8 is not particularly limited, the barrier ribs 8 are formed of a low-melting glass mixed with a metallic oxide, for example, and can be formed by screen printing and a sandblast process, for example.

The tops of the barrier ribs 8 are brought into close contact with a protective layer 34 formed on an innermost surface of the first substrate 4, and both ends of each of the barrier ribs 8 are sealed, whereby discharge spaces 20, or stripe-shaped sealed spaces, are formed between the barrier ribs 8. Each of the stripe-shaped discharge spaces 20 is partitioned by the barrier ribs 8. Fluorescent material layers 10*r*, 10*g*, and 10*b* for RGB are formed on a bottom surface on the second substrate 6 side and inner wall surfaces of the barrier ribs 8 in the discharge space 20 situated between the barrier ribs 8. Although the materials for the fluorescent material layers 10*r*, 10*g*, and 10*b* are not particularly limited, the fluorescent material layer 10*r* for R is, for example, formed of (Y, Gd) $BO_3$:Eu or the like; the fluorescent material layer 10*g* for G is formed of $Zn_2SiO_4$:Mn or the like; and, the fluorescent material layer 10*b* for B is formed of $BaMgAl_{10}O_{17}$:Eu or the like. Each of the fluorescent material layers 10*r*, 10*g*, and 10*b* receives vacuum ultraviolet rays generated by plasma occurring within the discharge space 20 and, thereby, emits display light of one of the colors, for example red, green, and blue.

A discharge gas such as, for example, a neon-xenon gas (mixed gas of neon and xenon) or a helium-xenon gas (mixed gas of helium and xenon) is sealed inside the discharge spaces 20. The sealing pressure of the discharge gas is 50 torr to 600 torr (6.7 kPa to 79.8 kPa), for example, and preferably 150 torr to 500 torr (20.0 kPa to 66.5 kPa), although it is not particularly limited to these examples.

In the present embodiment, the concentration of xenon in the discharge gas is preferably 10% or more by volume and 100% or less by volume, more preferably 20% by volume to 100% by volume, and most preferably 30% by volume to 70% by volume. As the concentration of xenon becomes higher, the luminous brightness tends to be improved, but the discharge voltage tends to be increased.

A first dielectric layer 30, a second dielectric layer 32, and the protective layer 34 are formed in that order into a laminate on a surface (surface on the discharge space 20 side) opposite to the display surface side surface 4*a* of the first substrate 4. As shown in FIG. 3, pairs of first discharge maintaining electrodes 40 are disposed in a stripe manner along the Y-direction and at predetermined intervals in the X-direction in such a manner as to correspond to each pixel between the first substrate and the first dielectric layer. The first discharge maintaining electrodes 40 are formed by transparent conductive films such as, for example, ITO films and tin oxide films. The first discharge maintaining electrode 40 has a thickness of about 50 to 400 nm, for example.

The pairs of first discharge maintaining electrodes 40 are disposed in a manner perpendicular to the address electrodes 12, and portions where the pairs of first discharge maintaining electrodes 40 and the address electrodes 12 intersect each other form display pixels.

Figure 4:
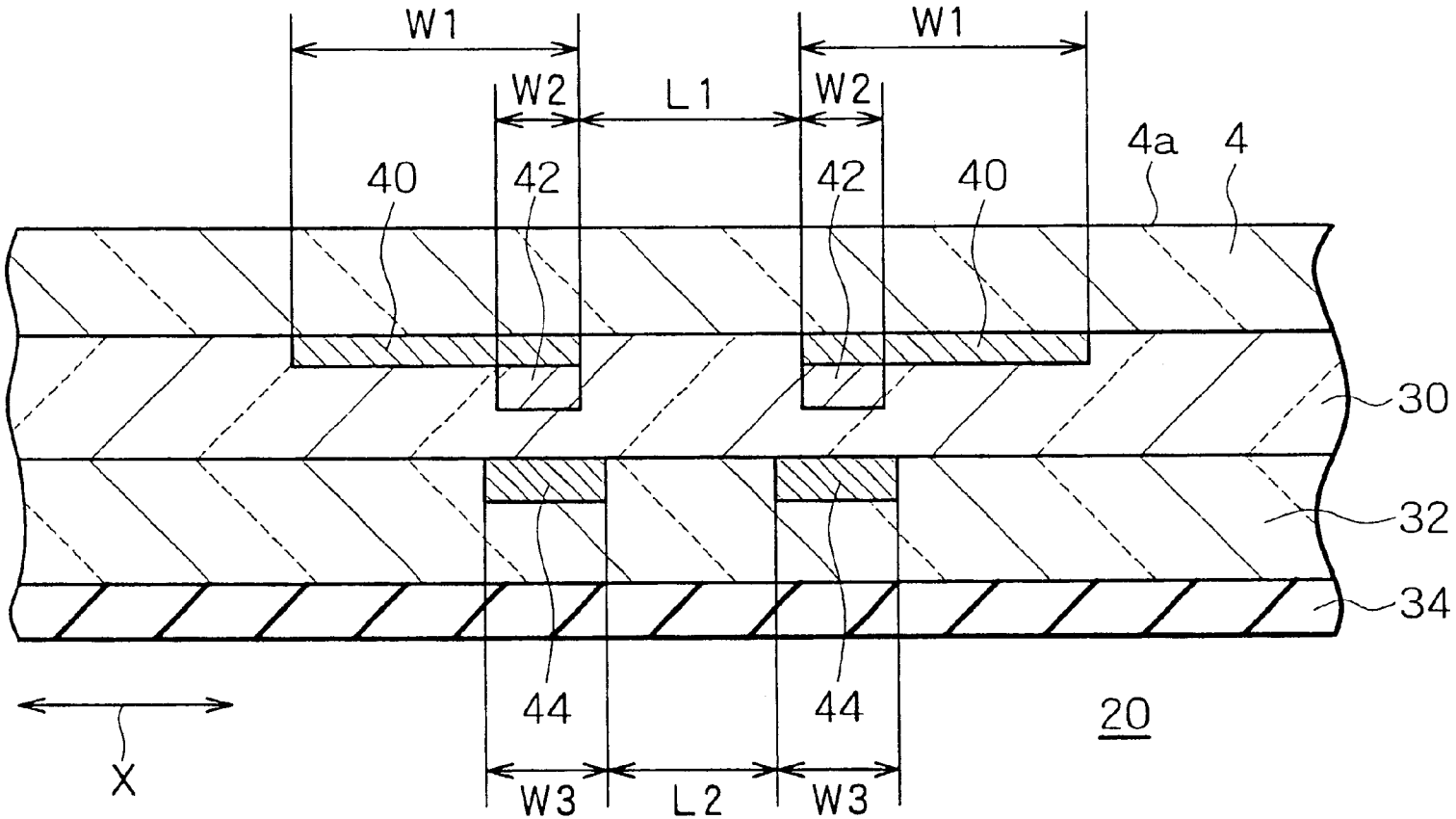
FIG. 4 is a partial sectional view of a first substrate side of the display panel shown in FIG. 2.

As shown in FIG. 4, bus electrodes 42 are formed in close contact with the first discharge maintaining electrodes 40 along the direction of length of the first discharge maintaining electrodes 40 (Y-direction) and at edge portions of the pair of first discharge maintaining electrodes 40 adjacent to each other. The bus electrodes 42 are formed by metallic films, which may be either single-layered or multi-layered, and are formed of Al film, Al alloy film, Cr—Al—Cr film, Cr—Cu—Cr film, Mo—Al film and the like. Although not particularly limited, the thickness of the bus electrodes 42 is about the same as the thickness of the electrodes 40, for example.

Second discharge maintaining electrodes 44 are formed between the first dielectric layer 30 and the second dielectric layer 32 in such a manner as to correspond to the first discharge maintaining electrodes 40 and completely overlap the bus electrodes 42, as viewed from the display surface side surface 4*a*. While the second discharge maintaining electrodes 44 are insulated by the first dielectric layer 30 from the corresponding first discharge maintaining electrodes 40 inside a display area 50 of the display panel 2 shown in FIG. 3, the second discharge maintaining electrodes 44 are connected electrically to the first discharge maintaining electrodes 40 at a lead electrode portion in a non-display area 52, so that the second discharge maintaining electrodes 44 are at the same potential as the first discharge maintaining electrodes 40. Although not particularly limited, the second discharge maintaining electrodes 44 are formed by metallic films similar to those of the bus electrodes 42, for example, and have a thickness substantially equal to that of the bus electrodes 42.

The first dielectric layer 30, the second dielectric layer 32, and the protective layer 34 are formed of transparent materials. For example, the first dielectric layer 30 is formed by a low-melting glass layer, and it has a thickness of 5 $\mu$m to 50 $\mu$m, preferably 5 $\mu$m to 20 $\mu$m. The first dielectric layer 30 can be formed by a paste coating process or the like.

The second dielectric layer 32 is formed by a thin film or the like including at least one of silicon oxides, silicon nitrides, and metallic oxides, and it has a thickness of preferably about 5 to 20 $\mu$m, and more preferably about 5 to 10 $\mu$m. It is preferable that the thickness of the second dielectric layer 32 be smaller than the thickness of the first dielectric layer 30 and about equal to or less than half of an inter-electrode distance L2 to be described later. The second dielectric layer 32 is formed by a CVD (Chemical Vapor Deposition) process, a vacuum deposition process, an ion plating process, a sputtering process, and other thin film forming processes. By reducing the thickness of the second dielectric layer 32, it is possible to lower the discharge voltage even when increasing the concentration of xenon in the sealed gas.

The protective layer 34 is formed by an MgO film or the like; and it is formed by a vacuum deposition process, an ion plating process or the like. The protective layer 34 has a thickness of about 0.5 to 1.0 $\mu$m, for example. The protective layer 34 has an effect of lowering the discharge voltage in the discharge space 20, and also it has a function of protecting the second dielectric layer 32 from damage by plasma.

As shown in FIG. 4, an electrode width W1 of each of the first discharge maintaining electrodes 40 in the present embodiment is about 200 to 400 $\mu$m, although it is not particularly limited to this example. A distance L1 between the pair of electrodes 40 is preferably about 5 to 50 $\mu$m. The total width (2×W1+L1) of the pair of electrodes 40 substantially corresponds to the width of a region of plasma occurring for each pixel.

An electrode width W2 of a bus electrode 42 is smaller than the electrode width W1 of the first discharge maintaining electrode 40 and is about 30 to 200 $\mu$m, for example.

An electrode width W3 of a second discharge maintaining electrode 44 is greater than the electrode width W2 of the bus electrode 42 and smaller than the electrode width W1 of the first discharge maintaining electrode 40. Specifically, the electrode width W3 is about one to three times greater than the electrode width W2. The electrode width W3 is determined such that each of the electrodes 44 completely hides one of the bus electrodes 42, as viewed from the discharge space 20 side.

A distance L2 between a pair of second discharge maintaining electrodes 44 is about equal to or less than the above-mentioned inter-electrode distance L1 and is preferably less than the distance L1. By making the distance L2 between the pair of second discharge maintaining electrodes 44 less than the inter-electrode distance L1, it is possible to lower the discharge voltage. However, making the inter-electrode distance L2 too short is not preferable because it may cause a short circuit, and also the shading electrodes 44 will block display light produced from a portion where the strongest plasma occurs within the discharge space 20. Thus, a preferable range of the inter-electrode distance L2 is about 5 to 50 $\mu$m.

Incidentally, only making the inter-electrode distance L2 short may increase the proportion of electric lines of force passing through the second dielectric layer 32 between the electrodes 44, whereby an electric field may not be applied effectively to the inside of the discharge space 20, and thus the discharge voltage may be increased instead. As described above, the present embodiment controls the increase in the discharge voltage by reducing the thickness of the second dielectric layer 32.

Example of Fabrication Method

Next, a description will be given of an example of a method for forming the dielectric layers and the electrodes described above on the inner surface (surface on the discharge space side) of the first substrate 4.

First, a transparent conductive film, such as an ITO film, is formed by a sputtering process, a vacuum deposition process or the like on the inner surface of a transparent glass substrate serving as the first substrate 4. Then, the transparent conductive film is patterned into stripes by a photoengraving process, an etching process and the like, whereby a plurality of pairs of stripe-shaped first discharge maintaining electrodes 40 is obtained.

Next, a metallic film of aluminum, copper, chromium, silver or the like, to serve as the bus electrodes 42, is formed by a sputtering process or the like on the inner surface of the first substrate 4 having the first discharge maintaining electrodes 40 formed thereon. Then, the metallic film is processed into a predetermined pattern with the above-mentioned arrangement by a photoengraving process and an etching process, whereby the bus electrodes 42 are obtained. Incidentally, instead of by the sputtering process, the bus electrodes 42 can be formed by a paste printing process, which prints a conductive paste obtained by dispersing metallic powder into a solvent.

Next, a dielectric paste is printed and then fired on the inner surface of the first substrate having the bus electrodes 42 and the first discharge maintaining electrodes 40 formed thereon, whereby the first dielectric layer 30 is formed.

Thereafter, a metallic film of aluminum, copper, chromium, silver or the like, to serve as the second discharge maintaining electrodes 44, is formed by a sputtering process or the like on the inner surface of the first substrate having the first dielectric layer 30 formed thereon. Then, the metallic film is processed into a predetermined pattern with the above-mentioned arrangement by a photoengraving process and an etching process, whereby the second discharge maintaining electrodes 44 are obtained. Incidentally, as with the bus electrodes 42, the second discharge maintaining electrodes 44 can be formed by a paste printing process, which prints a conductive paste obtained by dispersing metallic powder into a solvent, instead of by the sputtering process.

The second dielectric layer 32 is thereafter formed on the inner surface of the first substrate having the second discharge maintaining electrodes 44 formed thereon, by a CVD process, a vacuum deposition process, an ion plating process, a sputtering process, and other processes. An MgO film, to serve as the protective layer 34 is then formed by a deposition process, an ion plating process or the like, whereby the first substrate 4 is completed. As shown in FIG. 2, the protective layer 34 of the first substrate 4 is brought into close contact with the top of the barrier ribs 8 formed on the second substrate 6, thus sealing the insides between the barrier ribs 8, and thereby forming the stripe-shaped discharge spaces 20.

Example of Driving Method

Next, a description will be given of an example of a driving method of the plasma display panel 2 shown in FIG. 2. For a light-emission display, a predetermined discharge voltage is first applied between every pair of first discharge maintaining electrodes 40 shown in FIG. 3. Since the first discharge maintaining electrodes 40 are connected to the second discharge maintaining electrodes 44 shown in FIG. 2 and FIG. 4 in a non-display area, the discharge voltage also is applied between the pairs of second discharge maintaining electrodes 44. As a result, electric fields occurring between the second discharge maintaining electrodes 44 penetrate the second dielectric layer 32 and the protective layer 34, reach the discharge space 20, and cause a discharge phenomenon, thereby bringing discharge areas corresponding to all pixels into an activated state.

A required erasing discharge voltage is thereafter applied between a selected address electrode 12 and one of the pair of first discharge maintaining electrodes 40 to cause an erasing discharge at a pixel portion where the address electrode 12 and the first discharge maintaining electrode 40 intersect each other, whereby a discharge position corresponding to the pixel is brought into a deactivated state.

Next, a required alternating voltage is applied between every pair of first discharge maintaining electrodes 40. Thus, no discharge occurs at a pixel portion where an erasing discharge is caused, while discharge is maintained at a pixel portion where an erasing discharge is not caused. Vacuum ultraviolet rays generated by this discharge cause fluorescent material corresponding to the pixel portion to emit light. The light is emitted from the display surface side surface 4*a* of the first substrate 4 to produce a predetermined image display in the display area.

It is to be noted that while the above example of the driving method first brings discharge areas corresponding to all pixels into an activated state, a reverse method may be employed which first brings the discharge areas corresponding to all pixels into a deactivated state, causes discharge only at predetermined pixel portions using the address electrodes 12 (activation), and then applies alternating voltage to maintain the discharge.

A function of the embodiment will be described below.

The plasma display panel 2 according to the present embodiment has the second discharge maintaining electrodes 44 disposed between the dielectric layers 30 and 32 so that in addition to the first discharge maintaining electrodes 40, the second discharge maintaining electrodes 44 are situated close to the discharge space 20. Thus, even when using a filling gas with a high concentration of xenon as a discharge gas, which can improve brightness, it is possible to generate strong vacuum ultraviolet rays by plasma efficiently at a relatively low voltage.

In general, when a filling gas with a high concentration of xenon is used as a discharge gas, the discharge voltage is increased. In the present embodiment, the thickness of the second dielectric layer 32 formed on the discharge space side surface of the second discharge maintaining electrodes 44 is reduced, and also the distance L2 between a pair of second discharge maintaining electrodes 44 is shortened. Thus, it is possible to minimize the increase in the discharge voltage.

Simply reducing the thickness of the second dielectric layer 32 generally degrades withstand voltage characteristics of the dielectric layer, which may lead to a device breakdown due to an abnormal discharge. The present embodiment can improve the withstand voltage characteristics of the dielectric layer 32 by forming the second dielectric layer 32, such as a thin film including at least one of silicon oxides, silicon nitrides, and metallic oxides, by the thin film forming processes mentioned above.

Since the first discharge maintaining electrodes 40 are generally formed by a transparent conductive film, such as a transparent ITO film, the first discharge maintaining electrodes 40 do not block display light from the discharge space. However, the electric resistance of the transparent conductive film is higher than that of a metallic film. The present embodiment therefore provides the first discharge maintaining electrodes 40 with the bus electrodes 42 formed by a metallic film or the like having a low electric resistance. However, the bus electrodes 42 have a light shading property. The second discharge maintaining electrodes 44, which are formed by a metallic film or the like having a low resistance, also have a light shading property.

Hence, in the present embodiment, the bus electrodes 42 are optimally disposed such that the bus electrodes 42 are completely overlapped by the second discharge maintaining electrodes 44, as viewed from the display surface side surface 4*a* of the first substrate 4. The area blocking display light is thereby minimized, which results in improved brightness.

By making the electrode width W2 of the bus electrodes 42 smaller than the electrode width W3 of the second discharge maintaining electrodes 44 in disposing the bus electrodes 42 such that the bus electrodes 42 are completely overlapped by the second discharge maintaining electrodes 44, the bus electrodes 42 are completely included within shades of the second discharge maintaining electrodes 44 resulting from display light from the discharge space 20, thereby making it possible to extract a maximum amount of display light efficiently.

In the embodiment described above, the first dielectric layer 30 is formed by a dielectric paste printing process; however, the first dielectric layer 30 may be formed by the same thin film forming method as that of the second dielectric layer 32. Alternatively, both the first dielectric layer 30 and the second dielectric layer 32 may be formed by the dielectric paste printing process. From the viewpoint of improving withstand voltage characteristics while reducing the film thickness, however, it is desirable to form at least the second dielectric layer 32 by a thin film forming process.

While a preferred embodiment of the invention has been described using specific terms, such description is for illustrative purposes only, and it is to be understood that changes and variations may be made without departing from the spirit or scope of the following claims.

What is claimed is:

1. A plasma display panel comprising:

a transparent first substrate having a display surface side surface;

a second substrate disposed such that a sealed plasma discharge space is formed between said first substrate and said second substrate;

a first dielectric layer formed on a discharge space side surface of said first substrate opposite from said display surface side surface;

at least one pair of transparent first discharge maintaining electrodes formed in a stripe manner between said first substrate and said first dielectric layer;

a second dielectric layer formed on a discharge space side surface of said first dielectric layer;

at least one pair of second discharge maintaining electrodes formed in a stripe manner between said second dielectric layer and said first dielectric layer so as to correspond to said first discharge maintaining electrodes, said second discharge maintaining electrodes having an electric resistance lower than an electric resistance of said first discharge maintaining electrodes; and at least one pair of bus electrodes disposed so as to be overlapped by said second discharge maintaining electrodes along a direction of length of two edges adjacent to each other of said pair of first discharge maintaining electrodes as viewed from the display surface side surface of said first substrate, said bus electrodes having an electric resistance lower than the electric resistance of said first discharge maintaining electrodes.

2. A plasma display panel as claimed in claim 1, wherein a width of said bus electrodes is smaller than a width of said second discharge maintaining electrodes.

3. The plasma display panel as claimed in claim 2, wherein a distance between said pair of second discharge maintaining electrodes is smaller than a distance between said pair of bus electrodes.

4. The plasma display panel as claimed in claim 2, wherein a distance between said pair of second discharge maintaining electrodes is less than 50 $\mu$m and 5 $\mu$m or more.

5. The plasma display panel as claimed in claim 2, wherein a thickness of at least one of said first dielectric layer and said second dielectric layer is 20 $\mu$m or less and 5 $\mu$m or more.

6. The plasma display panel as claimed in claim 2, wherein at least one of said first dielectric layer and said second dielectric layer is formed by a thin film including at least one of silicon oxides, silicon nitrides, and metallic oxides.

7. The plasma display panel as claimed in claim 2, wherein at least one of said first dielectric layer and said second dielectric layer is formed by a thin film forming process.

8. The plasma display panel as claimed in claim 1, wherein a distance between said pair of second discharge maintaining electrodes is smaller than a distance between said pair of bus electrodes.

9. The plasma display panel as claimed in claim 8, wherein a distance between said pair of second discharge maintaining electrodes is less than 50 $\mu$m and 5 $\mu$m or more.

10. The plasma display panel as claimed in claim 8, wherein a thickness of at least one of said first dielectric layer and said second dielectric layer is 20 $\mu$m or less and 5 $\mu$m or more.

11. The plasma display panel as claimed in claim 8, wherein at least one of said first dielectric layer and said second dielectric layer is formed by a thin film including at least one of silicon oxides, silicon nitrides, and metallic oxides.

12. The plasma display panel as claimed in claim 8, wherein at least one of said first dielectric layer and said second dielectric layer is formed by a thin film forming process.

13. The plasma display panel as claimed in claim 1, wherein a distance between said pair of second discharge maintaining electrodes is less than 50 $\mu$m and 5 $\mu$m or more.

14. The plasma display panel as claimed in claim 13, wherein a thickness of at least one of said first dielectric layer and said second dielectric layer is 20 $\mu$m or less and 5 $\mu$m or more.

15. The plasma display panel as claimed in claim 13, wherein at least one of said first dielectric layer and said second dielectric layer is formed by a thin film including at least one of silicon oxides, silicon nitrides, and metallic oxides.

16. The plasma display panel as claimed in claim 13, wherein at least one of said first dielectric layer and said second dielectric layer is formed by a thin film forming process.

17. The A plasma display panel as claimed in claims 1, wherein a thickness of at least one of said first dielectric layer and said second dielectric layer is 20 $\mu$m or less and 5 $\mu$m or more.

18. The plasma display panel as claimed in claim 17, wherein at least one of said first dielectric layer and said second dielectric layer is formed by a thin film including at least one of silicon oxides, silicon nitrides, and metallic oxides.

19. The plasma display panel as claimed in claim 17, wherein at least one of said first dielectric layer and said second dielectric layer is formed by a thin film forming process.

20. The plasma display panel as claimed in claims 1, wherein at least one of said first dielectric layer and said second dielectric layer is formed by a thin film including at least one of silicon oxides, silicon nitrides, and metallic oxides.

21. The plasma display panel as claimed in claim 20, wherein at least one of said first dielectric layer and said second dielectric layer is formed by a thin film forming process.

22. The plasma display panel as claimed in claims 1, wherein at least one of said first dielectric layer and said second dielectric layer is formed by a thin film forming process.

23. A plasma display panel as claimed in any of claims 1 to 22, wherein said plasma discharge space is filled with a discharge gas, and concentration of xenon in the discharge gas is 10% or more by volume and 100% or less by volume.

* * * * *